United States Patent [19]

Hayashi et al.

[11] 4,348,201

[45] Sep. 7, 1982

[54] TANNING PROCESS AND TANNING COMPOSITIONS

[75] Inventors: Saburo Hayashi, Kakogawa; Syohiti Okada, Kobe; Kazuyoshi Okamoto, Hyogo; Mochifumi Mizutani, Himeji; Teizo Isono, Kakogawa; Toshio Osada, Himeji; Tohru Okabe, Hyogo; Mitsuji Adachi, Himeji, all of Japan

[73] Assignee: Seitetsu Kagaku Co., Ltd., Hyogo, Japan

[21] Appl. No.: 147,663

[22] Filed: May 7, 1980

[30] Foreign Application Priority Data

May 11, 1979 [JP] Japan ..... 54/58488
Apr. 17, 1980 [JP] Japan ..... 55/51323

[51] Int. Cl.[3] ..... C14C 1/04; C14C 3/06

[52] U.S. Cl. ..... 8/94.18; 8/94.26; 8/94.27

[58] Field of Search ..... 8/94.18, 94.26, 94.27

[56] References Cited

U.S. PATENT DOCUMENTS

| | | | |
|---|---|---|---|
| 3,138,610 | 6/1964 | Buc et al. | 8/94.18 |
| 3,415,935 | 12/1968 | Friker et al. | 8/94.18 |
| 3,482,925 | 12/1969 | Schmid et al. | 8/94.27 |
| 3,521,990 | 7/1970 | Schmid et al. | 8/94.18 |
| 3,870,464 | 3/1975 | Briggs | 8/94.29 |
| 4,211,529 | 7/1980 | Spahrkas et al. | 8/94.26 |

FOREIGN PATENT DOCUMENTS

| | | | |
|---|---|---|---|
| 141972 | 10/1960 | U.S.S.R. | 8/94.27 |
| 227488 | 2/1969 | U.S.S.R. | 8/94.18 |
| 244550 | 10/1969 | U.S.S.R. | 8/94.27 |
| 271704 | 9/1970 | U.S.S.R. | 8/94.18 |
| 308065 | 8/1971 | U.S.S.R. | 8/94.26 |
| 312873 | 12/1971 | U.S.S.R. | 8/94.26 |

*Primary Examiner*—Maria Parrish Tungol
*Attorney, Agent, or Firm*—Jordan and Hamburg

[57] ABSTRACT

A tanning process comprising pickling a hide which has previously subjected to beamhouse works such as depilation if necessary, decalcification and beating, in the presence of urotropin and at least one tanning improver selected from chromium and aluminum salts as well as from phenolic compounds, organic compounds containing nitrogen and sulphur or halogen atoms, organic carboxylic acids, organotin compounds, copper compounds and arsenic compounds.

27 Claims, No Drawings

TANNING PROCESS AND TANNING COMPOSITIONS

This invention relates to an improved tanning process and a tanning composition used therefor. More particularly it relates to a tanning process improved over a process disclosed in Japanese Patent Application 20517/78 (Japanese Patent Application Laying-Open Gazette 113401/79) filed by the same applicants as in the present application, the latter process comprising treating in a pickling bath incorporated with urotropin (hexamethylenetetramine) and then effecting chrome tanning in the same bath, and it also relates to a tanning composition used for the improved tanning process.

The tanning process disclosed in said Gazette 113401/79 is characterized by adding to a pickling bath 0.2–10 parts of urotropin per 100 parts of a hide(raw) and then effecting tanning with a chrome tanning agent in a less amount than usual in the presence or absence of a basicity adjuster such as sodium bicarbonate thereby to obtain satisfactory leathers (tanned) having substantially the same properties as conventional ones while greatly decreasing the chromium content in the waste effluent.

One of the hitherto known and widely used tanning processes comprises tanning with a chromium salt. As is widely known, the conventional chrome tanning process comprising pickling a hide which has been subjected to preliminary treatments (or beamhouse works) such as depilation, decalcification, beating and water washing, in a pickling bath containing an acid and a neutral salt and then adding a chromium tanning agent, a basicity adjuster and the like to the bath to tan the pickled hide therein. The main ingredient of the tanning solution usually used in this conventional tanning process is basic chromium sulphate expressed by $Cr(OH)SO_4$.

If a depilated, decalcified, beaten and water washed hide is immersed in said chrome tanning solution, the chromium will precipitate in the texture of the hide to inhibit the reaction thereof with the collagen, the protein of the hide, thereby to lose the tanning effect since the hide is weakly alkaline. Thus, it is necessary to make the hide acidic by subjecting to a pickling treatment as a preliminary treatment prior to being tanned. In the pickling treatment, sulphuric acid or a mixed liquid of sulphuric acid and formic acid is usually employed.

Since a hide tends to swell even in an acidic bath, a neutral salt such as sodium chloride is usually added thereto to prevent the swelling in the step of pickling. In general, 100 parts by weight of a hide are incorporated with 30–100 parts by weight of water and with sodium chloride in such an amount that a pickling solution to be prepared exhibits 6°–7° Be in a drum, after which the drum is rotated. About 10 minutes after the start of rotation of the drum, sulphuric acid or a mixed aqueous solution thereof with formic acid is added in such an amount that the resulting pickling solution has a pH value of about 3. The pickling treatment is thus carried out for 3–24 hours.

The pickling treatment is carried out usually at 10°–20° C. since the temperature is restricted in view of the fact that the thermal shrinkage temperature for the hide is 35°–40° C. If the pickling temperature is too high, that is, it rises near said thermal shrinkage temperature, the hide is abraded in the drum whereby the resulting tanned hide tends to create an abrasion on the surface and consequently degrade in quality.

The pickling solution or bath is incorporated with 5–10 (1.25–2.5 in terms of $Cr_2O_3$) parts by weight of a chrome tanning agent or a new bath containing the same tanning agent is prepared. The hide which has been pickled, is then immersed in the same bath incorporated with the tanning agent or in the new bath whereby the tannage thereof proceeds and the thermal shrinkage temperature therefor rises. In this case, the bath may be allowed to rise in temperature to about 40° C. During the tannage, an alkali agent such as sodium bicarbonate is usually added to the bath in order to raise the basicity of the chrome thereby increasing the reactivity thereof with the hide; in this case the sodium carbonate is added in aqueous solution and in portions, and the tannage is carried out for about 8 hours. The tanned hide is with drawn from the bath at the point where the final pH value of the bath is 3.5–4.0 and the thermal shrinkage temperature for the hide reaches 77°–120° C., or otherwise it is withdrawn from the bath after still leaving therein overnight. The tanned hide so withdrawn is aged at room temperature for 1–3 days, thereafter drained and then subjected to finishing treatments to obtain a product leather.

In the aforementioned tannage, the amount of chromium combined with the hide is usually 50–70% of the chrome tanning agent while the remainder thereof becomes a tannage waste effluent. Since chromium is a heavy metal and the disposal thereof without further treatments raises problems as to environmental pollution, it is necessary to remove and recover the chromium from the tannage waste effluent. To this end, there are plants where such a tannage waste effluent is subjected to chemical treatments and the like to remove the chromium therefrom and allow the chromium-free effluent to flow outside.

The leather so obtained by chrome tanning is characterized by its thermal shrinkage temperature in the bath being 77°–120° C. and, thus, it has satisfactory heat resistance, putrefaction-resistance and chemical resistance as compared with that obtained by other types of tanning. It has a further advantage that it does not greatly change in textural structure as compared with a non-tanned hide. Particularly, it is excellent in flexibility and resilience as compared with a leather obtained by vegetable tanning.

The applicants previously filed Japanese Patent Application 20517/78 (Japanese Patent Application Laying-Open Gazette 113401/79) for a patent on a process for minimizing the chromium content in the tannage waste effluent without imparing the aforesaid features of a leather to be obtained by chrome tanning. However, this published process requires a time of one day or longer from the start of pickling to the end of tanning, this being disadvantageous in operating an overall tanning equipment efficiently. If tannage is carried out in factories capable of operating tannage only once a day using the published process, the factories will require more of the equipment to produce the same amount of tanned hide (leather) as those capable of operating tannage using the same equipment more efficiently than the former or they will produce a less amount of product leather than the latter unless the tannage operation in the former can be operated more efficiently.

In addition, the temperature for the pickling treatment in said published process should preferably be in the range of 25°–30° C. to increase the effect obtained by the addition of urotropin and is higher than the temperature (10°–20° C.) for the pickling treatments in earlier conventional chrome tanning processes whereby the resulting leather disadvantageously tends to have abrasions caused by the mechanical friction between the hide and the drum during the rotation thereof. This tendency is particularly remarkable with a less fresh hide.

The present inventors made intensive studies in attempts to overcome these disadvantages and, as the result of their studies, found the following novel tanning process.

The process of this invention may preferably comprise introducing into a rotatable drum (made of wood for example) 100 parts by weight of a weakly alkaline hide having been subjected to preliminary treatments such as depilation, decalcification and water washing, 20–100 parts by weight of water and 5–10 parts by weight of sodium chloride or sodium sulphate, rotating the thus charged drum for 5–20 minutes, introducing 0.5–3 parts by weight of sulphuric acid or a mixture thereof with formic acid, together with 5–30 parts by weight of water, into the drum, rotating the drum for 20 minutes to 2 hours, adding within this time period 0.2–10 parts by weight of urotropin and 0.001–2 parts by weight of at least one tanning improver (or tannage improver) to the drum, the urotropin and tanning improver being added at the same time or added separately at a time interval of 5 minutes to 2 hours for example, rotating the drum for 1–12 hours to infiltrate the urotropin and tanning improver into the hide and, if desired, slowly adding a diluted sulphuric acid in such an amount that the ratio of urotropin to the total of sulphuric acid amounts to 0.5–1.0 followed by further rotating the drum for 2–5 hours, adding 0–1.5 parts by weight of a tanning agent such as a chrome tanning agent (as $Cr_2O_3$), rotating the drum for 5–10 hours and, if desired, thereafter allowing the drum to stand overnight in order to tan the pickled hide, and then withdrawing the tanned hide from the drum for finishing treatment to obtain a leather, particularly a leather which will not degrade with the lapse of time.

As is apparent from the above process of the present invention, the amount of a chrome tanning agent used is smaller than that used in the conventional tanning processes. It is particularly noted that there are cases where no chromium salt is required as an tanning agent in the final tanning step when the tanning agent used along with urotropin is a chromium salt. The tanned hide (or leather) from the drum is preferably aged for 1–3 days. The tanning improver may not always added at the time of pickling depending on the kind thereof and may be added at any time by the end of tanning or prior to aging.

The tanning improvers used herein include inorganic ones and organic ones and they may be used alone or in combination.

An object of this invention is to provide a process for producing a leather by tanning a hide in a shorter time using a smaller amount of a tanning composition including at least one tanning improver selected from chromium salts and aluminum salts.

Another object is to provide a tanning composition including at least one tanning improver selected from said metallic salts.

A still another object is to provide a process for producing a leather, which will not degrade with the lapse of time, by tanning a hide using a tanning composition including at least one tanning improver selected from specific organic compounds, organometallic compounds and inorganic compounds other than said chromium and aluminum salts.

A further object is to provide a process for producing a leather by tanning a hide using a tanning composition including said two types of tanning improvers.

A still further object is to provide a tanning composition including said two types of tanning improvers.

In one aspect of this invention, a neutral salt and sulphuric acid are added at the initial stage of the pickling step and, prior to the lapse of about 2 hours after said addition, a small amount of a chromium salt and/or aluminum salt may be added simultaneously with, before or after, the addition of urotropin. It is possible and convenient in the pickling step to add the chromium salt and/or aluminum salt in the form of a mixture thereof with the urotropin using this urotropin as a medium for mixing. Such a mixture or composition obtained by mixing 100 parts by weight of urotropin with 0.1–75 parts by weight of a chromium salt (as $Cr_2O_3$) and/or 0.1–2 parts by weight of an aluminum salt (as $Al_2O_3$), is very useful for the purpose of this invention. Under the tanning action in the presence of at least one of these tanning improvers, the thermal shrinkage temperature of the hide may be maintained at about 55° C. or higher thereby permitting the pickling temperature to rise beyond 30° C.; this not only enables the hide to be slightly tanned on the surface and made resistant to friction caused by mechanical rotation but also promotes the tannage effect obtainable by the reaction of the urotropin with the hide. It has thus been found possible that the pickling time is shortened and the total time for the pickling and tanning is reduced to 12–20 hours. This invention, in one aspect, is based on this finding or discovery.

According to this invention, sulphuric acid is added at the initial stage of the pickling step, within about 2 hours after which 0.01–0.2, preferably 0.05–0.1, parts of a chromium salt (as $Cr_2O_3$) and 0.1–1.2, preferably 0.5–1.5, parts of an aluminum salt (as $Al_2O_3$) are added whereby the hide becomes so heat-resistant as to be resistant to a thermal shrinkage temperature of as high as 50° C. or higher, not to speak of a thermal shrinkage temperature of about 35° C., and is strengthened in fibrous texture thus enabling it to be preferably at a higher temperature of 25°–35° C. than generally possible heretofore. In addition, the hide treated with a pickling solution so prepared has an increased resistance to friction caused by the drum rotation and the like thereby making it possible to prevent the resulting tanned hide or leather from being damaged.

In the meantime, it should be noted that all parts are by weight through the specification.

The chromium salts used in the pickling step of this invention may include $Cr_2(SO_4)_3$, $CrCl_3$ and $Cr(OH)SO_4$ which may also be used as a tanning agent; the aluminum salts used herein may include $Al_2(SO_4)_3$ and $AlCl_3$.

The mechanism of functions of these inorganic salts is not clearly known but is considered to be that the salts facilitate the reaction of urotropin with the hide thereby shortening the time necessary for the thermal shrinkage temperature and the pH value respectively reaching a fixed value in the pickling step and consequently hastening the time for addition of the chrome tanning agent. Thus, the total time taken for the pickling and the tanning is greatly reduced. The practice of pickling in this manner will permit the chrome tanning agent to be used in a smaller amount (only up to 1.5, preferably 0.01–1.5, parts as $Cr_2O_3$ for example) than conventional in order to obtain a leather having the same quality as a conventional one.

More particularly, the addition of 0.2–10 parts of urotropin and 0.1–2 parts of an aluminum salt as $Al_2O_3$, will permit a chrome tanning agent to be used in an amount of as small as 0.0025–1.5 parts as $Cr_2O_3$, which the addition of 0.2–10 parts of wrotropin and 0.01–0.15 parts of a chromium salt as $Cr_2O_3$, will permit a chrome tanning agent to be used in an amount of as small as up to 0.5, preferably 0.01–1.5, parts.

In addition, any chrome tanning agent may be dispensed with and a separate tanning step may consequently be omitted in a case where the tanning may also be effected with a chromium salt added in the pickling step. In this case, it is also possible to add other tanning agents such as mineral, vegetable tannin and synthetic tanning agents in substitution for the chrome tanning agents.

The use of too much of the chromium salt or aluminum salt will give a less tanning effect thereby resulting in the production of a leather having poor resilience or having a chromium- or aluminum-precipitated skin structure at the worst, this meaning that tanning effects are hindered. On the other hand, the use of an unduly small amount of the said inorganic salt will result in lengthening the time from the start of pickling to the end of tanning and degrading the resulting leather due to abrasion produced thereon without exhibiting the effects otherwise obtainable by the practice of this invention. The unsatisfactory leathers so obtained will sometimes change with the lapse of time, that is, they will gradually degrade in quality; for example, there may be cases where the thermal shrinkage temperature of the unsatisfactory leathers may lower by about 10% when 3 months have passed since the production thereof.

The present inventors made further studies in attempts to prevent the aforesaid degradation in quality and, as the result of their studies, they found that a composition prepared by adding at least one specific organic compound as a tanning improver to urotropin is effective in preventing the quality degradation.

In another aspect of this invention, at least one organic tanning improver is added at any stage of a tanning process including the step of pickling with a pickling solution containing urotropin thereby to eliminate the above-mentioned drawback and obtain a leather which will not change with the lapse of time. This invention is also based on this finding.

The process of this invention in the second aspect comprises the use of a tanning composition comprising, urotropin and at least one tanning improver selected from the group consisting of phenolic compounds, organic compounds containing nitrogen and sulphur atoms, organic compounds containing nitrogen and halogen atoms, organic carboxylic acids, organotin compounds, copper compounds and arsenic compounds.

The chromium and aluminum salt tanning improvers are hereinafter referred to as "inorganic tanning improvers", while the tanning improvers used in the second aspect of this invention are hereinafter referred to as "organic tanning improvers" for convenience sake.

The phenolic compounds used in this invention are compounds having at least one member of phenolic hydroxyl groups and phenolate groups which are considered to be produced from phenolic hydroxyl groups and alkali metals. They include phenol, cresol, naphthol, o-phenylphenol, sodium salt of o-phenylphenol, p-oxybenzoic acid, ethyl p-oxybenzoate and other alkyl esters of p-oxybenzoic acid, salicylic acid, 8-oxyquinoline, salicylic anilide, p-chloro-m-xylenol, pentachlorophenol, hexachlorophen, monochloro-o-phenylphenol, 2,2-methylene-bis-(4-chlorophenol), phenolsulfonic acid and zinc cresolsulfonate (these phenolic compounds being referred to as "specific phenolic compounds").

The organic compounds containing nitrogen and sulphur atoms used herein are those containing nitrogen and sulphur as well as carbon and hydrogen atoms in the molecule but not containing phenolic hydroxyl and phenolate groups. They include thiourea, 1,2-di-(3-methoxycarbonyl-2-thiourado-benzene and other thiourea type compounds, 2-mercaptobenzothiazole and various salts thereof, dibenzothiazyl disulphide and other benzothiazole type compounds, tetramethylthiuram disulphide and other thiuram type compounds, zinc dimethyldithiocarbamate, sodium diethyldithiocarbamate, potassium N-hydroxymethyl-N-methyldithiocarbamate and other dithiocarbamate type compounds, 2-mercaptobenzimidazole and zinc salt thereof, 2-(4'-thiazolyl)-benzimidazol and other imidazole type compounds, 2,3,5,6-tetrachloro-4-(methylsulfonyl)pyridine, zinc-2-pyridinethiol-1-oxide (these two compounds being referred to a sulphur-containing pyridine type compounds), N,N-dimethyl-N'-phenyl-N'-(fluorodichloromethylthio) sulfamide and N-(fluorodichloromethylthio) phthalimide (these two compounds being referred to as "fluorodichloromethylthioimide type compounds").

The organic compounds containing nitrogen and halogen atoms used herein are those containing nitrogen and halogen atoms as well as carbon and hydrogen atoms in the molecule but not containing phenolic hydroxyl groups, phenolate groups and sulphur atoms. They include dimethylcetylbenzylammonium chloride, dodecyltrimethylammonium chloride, dicetyldimethylammonium chloride, methyloxyethyl-dodecyloxyethylbenzylammonium chloride, salts which are considered to be produced from hexamethylenetetramine and allyl chloride, cetyl-trimethylammonium bromide, 1-dodecyl-2-methyl-3-benzyl-imidazolium chloride, 1,3-dibenzyl-2-methylimidazolium chloride, dodecyldi(aminoethyl)glycine hydrochloride, di(octyldiaminopropyl)glycine hydrochloride, dodecylguanidine hydrochlorate, polyhexamethylenebiguanidine hydrochlorate, lauryl-trimethylammonium, 2,4,5-trichlorophenoxyde and quaternary ammonium salts which are considered to be produced from amines, amino acids, guanidine type compounds, urea derivatives, urethanes, hydrazine type compounds and hydroxylamine, and amino acids, any one of halogenated hydrocarbons, hydrohalogenic acids, halogen-containing acids and the like (halogen-containing quaternary ammonium salts), chloroaniline, 2-chloropyridine, bis(p-chlorophenyldiguanide)hexane, 3-trifluoromethyl-4,4'-dichloro-N,N'-diphenylurea (these four compounds being referred to as "halogenated nitrogen-containing aromatic compounds"), trichloroisocyanuric acid and sodium dichloroisocyanurate (these two compounds being referred to as "halogenated isocyanuric type compounds").

The organic carboxylic acids used herein are those containing at least one carboxylic group but not containing phenolic groups, phenolate groups, nitrogen and sulphur atoms or nitrogen atoms and halogen atoms at the same time, and are also anhydrides, esters and salts which are considered to be derived from the carboxyl group portion of the said carboxylic acids. They include benzoic acid, aminobenzoic acid, acetic acid, butyric acid, mono-, di or trichloroacetic acid, sorbic acid, alginic acid, endic acid, chlorendic acid, dehydroacetic acid, ascorbic acid, erythorbic acid, 2-methyl-4-chlorophenoxyacetic acid, pyridinecarboxylic acid, maleic anhydride, β-propiolactone, gluconodeltalactone, butyl p-aminobenzoate, capric acid monoglyceride, 1,4-bis(-bromoacetoxy)-2-butene, benzyl bromoacetate, sodium alginate, sodium erythorbate, potassium sorbate, sodium(phenylthio)acetate and magnesium cinnamate (these organic carboxylic compounds being referred to as "specific organic carboxylic compounds)".

The organotin compounds used herein are those having at least one tin, carbon and hydrogen atoms. They include tetrabutyltin, tetraphenyltin, tripropyltin chloride, dibutyltin dichloride, trimethyltin hydride, triphenyltin hydroxide, tributyltin oxide, dimethyltin sulphide, hexaethyl distannane, triethyl isopropyl mercaptotin, triphenyltin acetate, dibutyltin dilaurate and bis(-tri-n-butyltin)mezodibromosuccinate.

The copper compounds used herein include inorganic copper compounds such as copper itself, copper oxide, copper hydroxide, copper sulphate, basic copper sulphate, basic copper chloride and basic copper silicate (these four copper salts being referred to as "copper salts of inorganic acids"). They may also be organocopper compounds having at least one copper, carbon and hydrogen atoms and include copper acetate, copper naphthenate, copper 8-hydroxyquinoline, copper chlorophyll and sodium copper chlorophyll.

The arsenic compounds used herein include inorganic aresenic compounds such as arcenic itself, arsenous anhydride, calcium arsenate and iron. They may be organoarsenic compounds having at least one arsenic, carbon and hydrogen atoms and include iron methylarsenate, ammonium iron methylarsenate, methylarsinbislauryl sulphide and methylarsinbisdimethyl dithiocarbamate and 10,10′-oxybisphenoxyarsin.

These organic tanning improvers used in the second aspect of this invention may be added simultaneously with, or separately from, urotropin and other materials in the pickling step, may be added in the tanning step or may be added in any treating step before or after the deodorizing step. A separate step of adding the tanning improvers may be set up; however, there are many cases where such a separate step is not necessitated. It is preferable in any event to add the improvers at any time by the end of tanning operation, in other words, the improvers may be added in any step before the treated hide is allowed to stand. In addition, said tanning improvers may be coexistent with a chromium and/or aluminum salt tanning improver in the pickling step. Any tanning improvers may also be added during, immediately before or after the step of deodorization with ammonia if such a deodorization with ammonia is effected.

The organic tanning improvers may be added in an amount of 0.001–1.0, preferably 0.01–0.1, part per 100 parts of a hide. The use of the improver in an amount smaller than said lower limit will not exhibit addition effects, while the use thereof in an amount larger than said upper limit will not exhibit increased effects and will sometimes have undesirable effects on the operation and the resulting product leather. These improvers may be dispersed alone or with a suitable medium or adjuvant (a liquid or inert solid, that is, a solvent, non-solvent, dispersant, spreader or the like; these materials including water, methyl ethyl ketone, mineral spirit, 1,4-butanediol, polypropylene glycol, butyl benzyl phthalate, di(2-ethylhexyl)phthalate, diisodecyl phthalate, epoxidized soybean oil and vinyl chloride-vinyl acetate copolymers) to form a solution, an emulsion, a dispersion in a powdery solid for being sprayed, applied or immersing therein. If necessary, the medium is removed by a suitable means such as drying. These procedures may be effected at a suitable time for carrying out the treatment or process of this invention. However, it is customary to add the tanning improver alone or with a suitable medium in the pickling or tanning step in order to carry out the process of this invention without increasing the number of steps, this being advantageous and preferable.

The organic tanning improvers are, in many cases, added together with urotropin in the pickling step; in this case, it is possible and convenient to preliminarily mix the organic improver with urotropin and then adding the resulting mixture or composition in the pickling step. Such a composition may be incorporated with the inorganic tanning improvers (chromium and aluminum salts). The compositions so obtained are very useful. The organic improvers may be incorporated with urotropin in an amount of 0.01–1000% by weight, based on the weight of the urotropin. It is, however, customary to use a tanning composition comprising urotropin and the improver in equal amounts, and it is the most convenient to determine the mixing ratio of urotropin to the improver as required.

The tanning compositions used herein may, of course, contain a tanning agent as desired.

According to this invention, it is possible to reduce the chromium content in the waste tanning solution effluent, shorten the time required for tanning and produce a leather having excellent quality and satisfactory resistance to degradation with the lapse of time.

This invention is applicable not only to chrome tanning processes using urotropin but also to other chrome tanning processes and tanning processes using vegetable tannin, a synthetic tanning agent or the like.

This invention will be better understood by the following non-limitative Examples and Comparative Examples wherein all parts are by weight unless otherwise specified.

In the Examples and Comparative Examples, the amounts of reagents used are expressed in "part(s)" per 100 parts of a hide which has previously been decalcified and beaten, and the measurement of the respective times at which the reagents were added was started at the time of the addition of sodium chloride.

It should be noted that the terms "depilate" and "decalcify" used herein have the same meanings as "unhair" and "delime", respectively.

It should also be noted that the term "beamhouse works" used herein is intended to mean depilation (if necessary), decalcification, beating and the like to be effected on a hide in the tanning industry.

EXAMPLE 1

Five sheets of steer hides, produced in North America, which had been subjected to beamhouse works (depilation, decalcification and beating in this case), were washed with 200 parts of water per 100 parts of the hide, drained for 5 minutes and found to weigh 7.5 Kg. This weight was hereinafter expressed in terms of 100 parts.

The thus drained hides (100 parts) were introduced into a test drum having a 1-m diameter and rotatable at a speed of 15 r.p.m. and incorporated with 20 parts of water and 6 parts of sodium chloride, after which the drum so charged was started to rotate. Ten minutes later the whole mass in the drum was incorporated with an aqueous solution of 2 parts of sulphuric acid in 20 parts of water, 25 minutes later incorporated with 2 parts of urotropin and 1 hour later incorporated with 0.3 parts of Beachrome-S(powdery chrome tanning agent containing 25% of $Cr_2O_3$, produced by Nippon Denko Co., Ltd.) (0.075 parts as $Cr_2O_3$). Then, the drum continued to rotate for 11 hours. Table 1 shows the time from the addition of the sodium chloride to the end of this 11-hour rotation of the drum, the temperature of a bath used, the thermal shrinkage temperature (hereinafter referred to as "Ts") of the tanned hide in the bath, and the pH thereof.

Subsequently, 3 parts of Beachrome (0.75 parts as $Cr_2O_3$) were added to the drum which was then rotated for 8 hours. When this rotation ended, the temperature of the bath was 38° C. The hide so tanned was withdrawn from the drum and allowed to stand for two days at room temperature for aging.

After all, it was 20 hours from the time of start of pickling to the time of end of tanning.

In Table 2 are shown the Ts, resilience and degree of damage of the thus obtained leather as well as the pH of the bath, the amount of the unreacted $Cr_2O_3$ remaining therein and the time required from the start of pickling to the end of tanning.

EXAMPLE 2

The procedure of Example 1 was followed as far as the aqueous solution of 2 parts of sulphuric acid in 20 parts of water was added. 25 minutes later the whole mass in the drum was incorporated with 2 parts of urotropin and 0.1 part of Beachrome-S(0.025 parts as $Cr_2O_3$), after which the drum continued to rotate for 3 hours. When this 3-hour rotation completed, the pH of the bath was 3.0 and the Ts of the treated hide 65° C.

3 hours and 25 minutes later 3.2 parts of Beachrome(0.8 parts as $Cr_2O_3$) were added to the drum, and the drum continued its rotation for 9 hours (the temperature of the bath at the time of completion of this rotation being 38° C.), after which an aqueous solution of 2.6 parts of ammonium bicarbonate in 15 parts of water was added in 3 one-third portions at a time interval of 60 minutes and the drum continued its rotation for further 30 minutes.

The tanned hide (or leather) was withdrawn from the drum and allowed to stand at room temperature for 2 days for aging.

After all, it took a total of about 16 hours to carry out the pickling and tanning.

In Table 2 are indicated the quality of the thus obtained leather, the properties of the bath, the time required for tanning, and the like.

EXAMPLE 3

The procedure of Example 1 was followed as far as the addition of the aqueous solution of 2 parts of sulphuric acid in 20 parts of water. 25 minutes later a composition comprising 2 parts of urotropin and 0.3 parts of Beachrome-S was added to the drum and the drum continued its rotation for 3 hours. In Table 1 are shown the time required from the addition of the sodium chloride to the end of this 3-hour rotation, the temperature of the bath at this time, the Ts of the tanned hide and the pH of the bath.

Then, the procedure of tanning of Example 1 was followed. The results are shown in Table 2.

EXAMPLE 4

The procedure of Example 1 was followed except that a composition comprising 2 parts of urotropin and 0.5 parts of Beachrome-S(0.125 parts as $Cr_2O_3$) was added to the drum and 2.8 parts of Beachrome-S (0.7 parts as $Cr_2O_3$), in place of 3.0 parts thereof, were added thereto. The results are shown in Table 2.

EXAMPLE 5

The procedure of Example 1 was followed except that a composition comprising 2 parts of urotropin and 3 parts of aluminum sulphate [$Al_2(SO_4)_3.18H_2O$] (0.45 parts as $Al_2O_3$) was added to the drum. The pH of the bath prior to the addition of Beachrome was 3.4 and the Ts 63° C. Table 2 shows the quality of the thus obtained leather, the properties of the bath, the time required for the tanning, and the like.

EXAMPLE 6

The procedure of Example 1 was followed as far as the addition of the aqueous solution of 2 parts of sulphuric acid in 20 parts of water. 15 minutes later 0.354 parts of chromium sulphate [$Cr_2(SO_4)_3.18H_2O$] (0.075 parts as $Cr_2O_3$) were added thereto and 25 minutes later 2 parts of urotropin were added thereto, after which the drum continued its rotation for 11 hours. The following procedure of chrome tanning was the same as in Example 1. The results obtained were the same as those obtained in Example 1.

EXAMPLE 7

The procedure of Example 1 was followed except that chromium chloride ($CrCl_3$) (0.075 parts as $Cr_2O_3$) was used in substitution for the 0.3 parts of Beachrome-S. The results obtained were the same as those obtained in Example 1.

EXAMPLE 8

The procedure of Example 5 was followed except that aluminum chloride ($AlCl_3$) (0.45 parts as $Al_2O_3$) and chromium sulphate [$Cr_2(SO_4)_3$] (0.075 parts as $Cr_2O_3$) were substituted respectively for the $Al_2(SO_4)_3.18H_2O$ and the Beachrome-S. The results obtained were the same as those obtained in Example 5.

EXAMPLE 9

The procedure of Example 1 was followed except that chromium sulphate [$Cr_2(SO_4)_3$] (0.075 parts as $Cr_2O_3$) was substituted for the Beachrome-S and aluminum sulphate [$Al_2(SO_4)_3$] (0.23 parts as $Al_2O_3$) was used. The results obtained were the same as those obtained in Example 1.

COMPARATIVE EXAMPLE 1

The procedure of Example 1 was followed except that 0.7 parts of Beachrome-S (0.18 parts as $Cr_2O_3$) and 2.6 parts of Beachrome-S (0.65 parts as $Cr_2O_3$) were substituted respectively for 0.3 parts of Beachrome-S added together with the urotropin and 3.0 parts of Beachrom-S added in the tanning step. The results obtained were shown in Table 2.

COMPARATIVE EXAMPLE 2

The procedure of Example 1 was followed as far as the addition of urotropin, and the drum was rotated for 4 hours without the addition of a chrominum salt or aluminum salt and allowed to stand overnight for further immersion of the treated hide therein. In Table 1 are shown the time required from the addition of the sodium chloride to the end of this 4-hour rotation, the temperature of the bath, the Ts of the treated hide and the pH thereof. Twenty-two (22) hours after the addition of sodium chloride, 3.3 parts of Beachrome-S (0.83 parts as $Cr_2O_3$) were added to the drum and the drum was rotated for 8 hours, after which the temperature of the bath was 38° C.

The tanned hide was withdrawn from the drum and then allowed to stand at room temperature for 2 days. The results are shown in Table 2.

COMPARATIVE EXAMPLE 3

In accordance with the conventional chrome tanning formulation, 100 parts of a decalcified hide were introduced into a drum and incorporated with 80 parts of water and 8 parts of sodium chloride, and the drum began to be rotated. Ten minutes later the whole mass in the drum was incorporated with 0.8 parts of sulphuric acid and 0.4 parts of formic acid, 3 hours later incorporated with 3.3 parts of Beachrome-S (0.83 parts as $Cr_2O_3$) and 5 hours later incorporated in four portions at a time interval of 30 minutes with an aqueous solution of 0.3 parts of sodium bicarbonate in 3 parts of water.

Elven (11) hours after the addition of sodium chloride the rotation of the drum was stopped and, at this time, the temperature of the bath was 38° C. After allowing the treated hide to be immersed for 1 hour in the drum, the tanned hide was withdrawn therefrom and then aged for 2 days. The results are shown in Table 2.

TABLE 1

| | Time required (hr) | Temp. of bath (°C.) | Ts of tanned hide (leather) (°C.) | PH of bath | Ts after aging overnight (°C.) |
|---|---|---|---|---|---|
| Example 1 | 12 | 45 | 71 | 4 | 85 |
| Example 3 | 3 | 35 | 65 | 3 | 85 |
| Comparative | | | | | |

TABLE 1-continued

| | Time required (hr) | Temp. of bath (°C.) | Ts of tanned hide (leather) (°C.) | PH of bath | Ts after aging overnight (°C.) |
|---|---|---|---|---|---|
| Example 2 | 22 | 30 | 56 | 4 | 70 |

COMPARATIVE EXAMPLE 4

The procedure of Comparative Example 3 was followed except that 8 parts of Beachrome-S (2.00 parts as $Cr_2O_3$) were substituted for 3.3 parts of Beachrome-S (0.83 parts as $Cr_2O_3$). The results are shown in Table 2.

In Table 2, the time required for tanning indicates the one beginning at the start of pickling and ending at the end of tanning. The symbol "O" indicates that the leathers obtained by the present process are equal in resilience and damage to those obtained by the conventional chrome tanning processes, while the symbol "X" indicates the inferiority of the former to the latter in the same respects as above.

TABLE 2

| | Time required for tanning (hr) | PH at the end of tanning | Amount of unreacted $Cr_2O_3$ at the end of tanning in bath $Cr_2O_3$ g/100 ml | Tanned hide (leather) Ts (°C.) | Degree of damage | Resilience of tanned hide (leather) |
|---|---|---|---|---|---|---|
| Example 1 | 20 | 3.7 | 0.1 | 110 | O | O |
| Example 2 | 16 | 5.5 | 0.0002 | 110 | O | O |
| Example 3 | 12.5 | 3.7 | 0.1 | 111 | O | O |
| Example 4 | 12.5 | 3.8 | 0.1 | 110 | O | O |
| Example 5 | 12.5 | 3.7 | 0.2 | 107 | O | O |
| Comp. Example 1 | 12.5 | 3.7 | 0.1 | 111 | O | X |
| Comp. Example 2 | 46 | 3.8 | 0.1 | 110 | X | O |
| Comp. Example 3 | 21 | 3.7 | 0.2 | 97 | O | O |
| Comp. Example 4 | 24 | 3.7 | 0.8 | 109 | O | O |

EXAMPLE 10

100 parts of a kip hide, produced in North America, which had been depilated, calcified and beaten, 100 parts of water and 7 parts of sodium sulphate were charged into a drum. After the rotation of the thus charged drum for 10 minutes, the whole mass therein was incorporated with a solution of 0.9 parts of sulphuric acid and 0.4 parts of formic acid in 10 parts of water to form a bath. The drum was rotated for 2 hours while keeping the bath at 10° C. therein and then allowed to stand overnight.

The bath was incorporated with 4 parts of urotropin and with each of the amounts of the tanning improvers as shown in Table 3; the drum was rotated for 3 hours, after which a 10% sulphuric acid was added over a time period of 20 minutes to the drum until a molar ratio of urotropin to sulphuric acid therein amounted to 1.0. The drum was rotated for further 3 hours and allowed to stand overnight for immersion of the treated hide therein. Then, 3 parts of Beachrome-S were added to the drum, the drum was rotated for 5 hours, 2 parts of sodium bicarbonate in 2% aqueous solution were added to the drum and the drum was rotated for 5 hours.

The tanned hide (leather) was withdrawn from the drum and aged at room temperature for 2 days. The leather so obtained was allowed to stand at room temperature for measuring the thermal shrinkage temperature thereof with the lapse of time. The results are shown in Table 3.

EXAMPLE 11

100 parts of a steer hide, produced in North America, which had been depilated, decalcified and beaten, 20 parts of water and 6 parts of sodium chloride as a neutral salt, were introduced into a drum which was rotated for 10 minutes. An aqueous solution of 1.8 parts of sulphuric acid in 18 parts of water was introduced into the drum which was rotated for 10 minutes.

Then, 2.0 parts of a mixture containing urotropin and bis(p-chlorophenyldiguanide) hexane in a molar ratio of 30:1 were added to the drum, after which the drum was rotated for 4 hours and then allowed to stand overnight for immersion of the treated hide in the bath. Thereafter, 3 parts of Beachrome-S were introduced into the drum which was rotated for 7.5 hours and allowed to stand overnight for immersion of the treated hide in the bath.

The tanned hide (or leather) was withdrawn from the drum and aged at room temperature for 2 days.

The leather so obtained was allowed to stand at room temperature for 140 days with the result that no decrease in the thermal shrinkage temperature of the leather was not appreciated.

EXAMPLE 12

The procedure of Example 10 was followed except that each of the organic tanning improvers according to this invention was added one hour after the addition of sodium bicarbonate and each organic improver was added in an amount of 0.05 parts. The organic tanning improvers used are 11 ones and they were zinc salt of 2-mercaptobenzothiazole, sodium (phenylthio) acetate, magnesium cinnamate, dehydroacetic acid, sodium erysorbate, 2-methyl-4-chlorophenoxyacetic acid, cyannuric chloride, cresol soap solution, dodecyltrimethylammonium bromide, N,N-dimethyl-N'-phenyl-N'-(fluorodichloromethylthio) sulfamide and 10,10'-oxybisphenoxyarsin. The results are that 140 days later, each of the leathers obtained exhibited a thermal shrinkage temperature of at least 105° C.

TABLE 3

| Tanning improver | Amount added (parts per 100 parts of hide) | Thermal shrinkage temperature in bath (°C.) Immediately after the end of tanning | 90 days later | 140 days later |
|---|---|---|---|---|
| P-chloro-m-xylenol | 0.04 | 111 | 108 | 107 |
| " | 0.1 | 110 | 108 | 108 |
| Ethyl p-oxybenzoate | 0.04 | 110 | 107 | 106 |
| " | 0.1 | 112 | 110 | 110 |
| Dimethylzinc carbamate | 0.04 | 111 | 108 | 108 |
| " | 0.1 | 112 | 111 | 111 |
| 2-mercaptobenzimidazole | 0.04 | 114 | 112 | 111 |
| " | 0.1 | 115 | 114 | 114 |
| Dimethylcetylammonium chloride | 0.04 | 110 | 108 | 108 |
| " | 0.1 | 112 | 110 | 110 |
| Dodecyltrimethylammoniun chloride | 0.04 | 110 | 109 | 109 |
| " | 0.1 | 111 | 110 | 110 |
| Polyhexamethylenebiguanidine hydrochloride | 0.04 | 109 | 107 | 107 |
| " | 0.1 | 110 | 107 | 107 |
| Dodecyldi(aminoethyl)glycine hydrochloride | 0.04 | 112 | 108 | 107 |
| " | 0.1 | 112 | 109 | 109 |
| Sodium alginate | 0.04 | 114 | 109 | 108 |
| " | 0.1 | 114 | 110 | 109 |
| Pyradinecarboxylic acid | 0.04 | 109 | 104 | 104 |
| " | 0.1 | 110 | 105 | 105 |
| Ascorbic acid | 0.04 | 113 | 107 | 105 |
| " | 0.1 | 114 | 108 | 107 |
| Triphenyltin hydroxide | 0.04 | 110 | 108 | 107 |
| " | 0.1 | 110 | 108 | 107 |
| Copper 8-hydroxyquinoline | 0.04 | 112 | 108 | 108 |
| " | 0.1 | 112 | 109 | 109 |
| Methylarsinbislauryl sulphide | 0.04 | 110 | 106 | 106 |
| " | 0.1 | 111 | 108 | 108 |
| Caberside RX *1 | 0.04 | 115 | 113 | 113 |
| " | 0.1 | 115 | 114 | 113 |
| None | 0 | 114 | 105 | 95 |

*1 Main component: mercaptobenzimidazole type compound, produced by Takeda Chemical Industries, Ltd.

EXAMPLE 13

60 sheets of a steer hide (produced in North America) having been depilated, decalcified and beaten, were washed with 200 parts of water per 100 parts of the hide, drained and found to weigh 780 Kg.

The thus drained hides were introduced into a wooden drum having a 2-m diameter and capable of rotating at a speed of 10 r.p.m. and incorporated with a solution of 1.5 parts of sulphuric acid in 18 parts of water. After the rotation of the drum for 5 minutes, 1.8 parts of urotropin were introduced into the drum which was rotated for 4 hours. Thereafter, the drum was allowed to stand overnight for immersion of the treated hides in the bath.

After the drum was rotated for 30 minutes next morning, 3 parts of Beachrome-S and 0.1 part of 2-mercaptobenzoimidazole were introduced into the drum which continued its rotation.

While rotating the drum, an aqueous solution of 2.6 parts of ammonium bicarbonate in 15 parts of water were introduced in three on-third portions at a time interval of 60 minutes to the drum which was rotated for 30 minutes. At this time, the tanned hides and the bath had entirely lost their objectionable odour. The tanned hides were withdrawn from the bath and allowed to stand at room temperature for aging for 2 days.

The thus obtained leathers had a thermal shrinkage temperature of 113° C. in the bath and 110° C. even after having been allowed to stand for 140 days. These thermal shrinkage temperatures were hardly different from those of leathers obtained by conventional chrome tanning. The leathers obtained in this Example were subjected to finishing treatments such as dyeing, oiling and the like by the use of conventional methods to obtain finished leathers, and the finished leathers so obtained were not appreciated to be different in appearence and physical strength from those obtained from leathers prepared by the conventional chrome tanning.

EXAMPLE 14

The procedure of Example 1 was followed as far as the addition of 2 parts of urotropin. One hour later 0.3 parts of Beachrome-S (0.075 parts as $Cr_2O_3$) and 0.1 part of p-chloro-m-xylenol were introduced into the drum which was rotated for 11 hours.

Three parts of Beachrome-S were then introduced into the drum which was rotated for 8 hours, after which the tanned hide was withdrawn from the drum and allowed to stand at room temperature for aging for 2 days.

The tanned hide so obtained had a thermal shrinkage temperature of 110° C. in the bath at the time of completion of tannage and such a temperature of 108° C. after having been allowed to stand at room temperature for 140 days.

EXAMPLE 15

The procedure of Example 11 was followed except that a composition comprising urotropin, bis(p-chlorophenyldiguanido) hexane and aluminum sulphate in a wt. ratio of 20:1:0.5 (as $Al_2O_3$) was substituted for the composition comprising urotropin and bis(p-chlorophenyldiguanido) hexane in a wt. ratio of 30:1. The leather so obtained was not appreciated to decrease in thermal shrinkage temperature even after having been allowed to stand at room temperature for 140 days.

EXAMPLE 16

The procedure of Example 11 was followed except that 4 parts of a composition comprising urotropin, Beachrome-S, $Al_2(SO_4)_3$, Cu $SO_4$ and pentachlorophenol in wt. ratio of 2:0.3:1.5:0.1:0.1 were substituted for the composition comprising urotropin and bis(p-chlorophenyldiguanido) hexane in a wt. ratio of 30:1. The leather so obtained was not appreciated to decrease in thermal shrinkage temperature even after having been allowed to stand at room temperature for 140 days.

What is claimed is:

1. A pretanning process comprising pickling a hide which has previously been subjected to beamhouse works, in the presence of hexamethylene-tetramine, an acid selected from the group consisting of sulfuric acid and a mixture of sulfuric and formic acid and at least one tanning improver selected from the group consisting of chromium salts and aluminum salts.

2. A pretanning process according to claim 1, further comprising chrome tanning the pickled hide.

3. A pretanning process according to claim 1 or 2, wherein hexamethylene-tetramine is used in an amount by weight of 0.2–10 parts per 100 parts by weight of the hide.

4. A pretanning process according to claim 1 or 2, wherein the chromium salt is used in an amount by weight of 0.01–0.2 parts as $Cr_2O_3$ per 100 parts by weight of the hide.

5. A pretanning process according to claim 1 or 2, wherein the aluminum salt is used in an amount by weight of 0.1–2 parts as $Al_2O_3$ per 100 parts by weight of the hide.

6. A pretanning process according to claim 4, wherein the chromium salt is $Cr(OH)SO_4$, $Cr_2(SO_4)_3$ or $CrCl_3$.

7. A pretanning process according to claim 5, wherein the aluminum salt is $Al_2(SO_4)_3$ or $AlCl_3$.

8. A pretanning process according to claim 2, wherein a chromium salt used in the chrome tanning is a basic chromium salt and it is used in an amount by weight of up to 1.5 parts as $Cr_2O_3$.

9. A pretanning composition comprising hexamethylenetetramine and a tanning improver selected from the group consisting of chromium salts and aluminum salts, the hexamethylenetetramine and the tanning improver being used in said pickling of claim 1.

10. A pretanning composition according to claim 9, wherein the chromium is used in an amount by weight of 0.1–100 parts as $Cr_2O_3$ per 100 parts of the hexamethylenetetramine.

11. A pretanning composition according to claim 10, wherein the chromium salt is $Cr(OH)SO_4$, $Cr_2(SO_4)_3$ or $CrCl_3$.

12. A pretanning composition according to claim 9, wherein the aluminum salt is used in an amount by weight of 1–1000 parts as $Al_2O_3$ per 100 parts of the hexamethylenetetramine.

13. A pretanning composition according to claim 11, wherein the aluminum salt is $Al_2(SO_4)_3$ or $AlCl_3$.

14. A pretanning process comprising pickling a hide which has previously been subjected to beamhouse works, in the presence of hexamethylenetetramine, an acid selected from the group consisting of sulfuric acid and a mixture of sulfuric and formic acid and at least one tanning improver selected from the group consisting of phenolic compounds, thiourea type compounds, benzothiazole type compounds, thiuram type compounds, dithiocarbamate type compounds, imidazole type compounds, sulphur-containing pyridine type compounds, fluorodichloromethylthiomide type compounds, halogen-containing quaternary ammonium salts, halogenated nitrogen-containing aromatic compounds, halogenated isocyanuric type compounds, organic carboxylic compounds, organotin compounds, copper, copper oxides and copper hydroxides, copper salts of inorganic acids, organocopper compounds and arsenic compounds.

15. A pretanning process according to claim 14, further comprising chrome tanning the pickled hide.

16. A pretanning process according to claim 14 or 15, wherein hexamethylenetetramine is used in an amount by weight of 0.2–10 parts per 100 parts of the hide.

17. A pretanning process according to claim 14 or 15, wherein the tanning improver is used in an amount by weight of 0.001–1 parts per 100 parts by weight of the skin.

18. A pretanning process according to claim 14 or 15, wherein the tanning improver is an imidazole type compound.

19. A pretanning process according to claim 14 or 15, where the tanning improver is a halogen-containing quaternary ammonium salt.

20. A pretanning process according to claim 1 or 14 wherein said hexamethylenetetramine and said tanning improver are added to a solution of 0.5–3 parts by weight of said mixture of sulfuric acid and formic acid in a weight ratio of 1:0.44 in 5–30 parts by weight of water in the presence of 100 parts by weight of said hide.

21. A pretanning composiion comprising hexamethylenetetramine, an acid selected from the group consisting of sulfuric acid and a mixture of sulfuric and formic acid and at least one tanning improver selected from the group consisting of phenolic compounds, thiourea type compounds, benzothiazole type compounds, thiuram type compounds, dithiocarbamate type compounds, imidazole type compounds, sulphur-containing tyridine type compounds, fluorodichloromethylthioimide type compounds, halogen-containing quaternary ammonium salts, halogenated nitrogen-containing aromatic compounds, halogenated isocyanuric type compounds, organic carboxylic compounds, organotin compounds, copper, copper oxides and copper hydroxides, copper salts of inorganic acids, organocopper compounds and arsenic compounds.

22. A pretanning composition according to claim 21, wherein the tanning improver is used in an amount by weight of 0.01–500 parts per 100 parts by weight of the hexamethylenetetramine.

23. A pretanning composition according to claim 21, wherein the tanning improver is imidazole type compounds.

24. A pretanning composition according to claim 21, wherein the tanning improver is a halogen-containing quaternary ammonium salt.

25. A pretanning composition comprising (1) hexamethylenetetramine, (3) an acid, selected from the group consisting of sulfuric acid and a mixture of sulfuric and formic acid at least one tanning improver selected from the group consisting of chromium salts and aluminium salts and (4) at least one tanning improver selected from the group consisting of phenolic compounds, thiourea type compounds, benzothiazole type compounds, thiuram type compounds, dithicarbamate type compounds, imidazole type compounds, sulphur-containing pyridine type compounds, fluorodichloromethylthioimide type compounds, halogen-containing quaternary ammonium salts, halogenated nitrogen-containing aromatic compounds, halogenated isocyanuric type compounds, organic carboxylic compounds, organotin compounds, copper, copper oxides and copper hydroxides, copper salts of inorganic acids, organocopper compounds and arsenic compounds.

26. A pretanning composition according to claim 25, wherein the chromium salt and the aluminum salt as the tanning improvers (2) are used in respective amounts by weight of 0.1–100 parts as $Cr_2O_3$ and 1–1000 parts as $Al_2O_3$ per 100 parts by weight of hexamethylenetetramine, and the tanning improver (3) is used in an amount by weight of 0.01–500 parts per 100 parts by weight of hexamethylenetetramine.

27. In a pretanning process comprising a pickling step including the use of hexamethylenetetramine and an acid selected from the group consisting of sulfuric acid and a mixture of sulfuric and formic acid and a tanning step, said process wherein a tanning improver is added at any time except in the pickling step and by the end of the tanning step, the tanning improver being at least one member selected from the group consisting of phenolic compounds, thiourea type compounds, benzothiazole type compounds, thiuram type compounds, dithiocarbamate type compounds, imidazole type compounds, sulphur-containing pyridine type compounds, fluorodichloromethylthioimide type compounds, halogen-containing quaternary ammonium salts, halogenated nitrogen-containing aromatic compounds, halogenated isocyanuric type compounds, organic carboxylic compounds, organotin compounds, copper, copper oxides and copper hydroxides, copper salts of inorganic acids, organocopper compounds and arsenic compounds.

* * * * *